US007852295B2

(12) United States Patent
Lee et al.

(10) Patent No.: US 7,852,295 B2
(45) Date of Patent: Dec. 14, 2010

(54) PLASMA DISPLAY DEVICE AND METHOD OF DRIVING THE SAME

(75) Inventors: Joo-Yul Lee, Yongin-si (KR); Tae-Hyun Kim, Yongin-si (KR)

(73) Assignee: Samsung SDI, Co., Ltd., Yongin (KR)

( * ) Notice: Subject to any disclaimer, the term of this patent is extended or adjusted under 35 U.S.C. 154(b) by 1026 days.

(21) Appl. No.: 11/599,779

(22) Filed: Nov. 15, 2006

(65) Prior Publication Data

US 2007/0115216 A1 May 24, 2007

(30) Foreign Application Priority Data

Nov. 18, 2005 (KR) ..... 10-2005-0110679

(51) Int. Cl.
*G09G 3/28* (2006.01)
*G09G 3/10* (2006.01)

(52) U.S. Cl. ..... 345/67; 345/60; 345/63; 315/169.3

(58) Field of Classification Search ..... 345/60–67
See application file for complete search history.

(56) References Cited

U.S. PATENT DOCUMENTS

| | | | | |
|---|---|---|---|---|
| 6,294,875 | B1 | 9/2001 | Kurata et al. | |
| 2002/0008680 | A1 * | 1/2002 | Hashimoto et al. | 345/63 |
| 2003/0107532 | A1 * | 6/2003 | Choi | 345/60 |
| 2004/0196216 | A1 | 10/2004 | Shindo et al. | |
| 2005/0259042 | A1 | 11/2005 | Lee | |
| 2006/0055636 | A1 * | 3/2006 | Kim et al. | 345/63 |
| 2006/0114183 | A1 * | 6/2006 | Jung et al. | 345/67 |

FOREIGN PATENT DOCUMENTS

| | | | |
|---|---|---|---|
| EP | 1 598 801 | A1 | 11/2005 |
| EP | 1 657 701 | A1 | 5/2006 |
| EP | 1 657 702 | A2 | 5/2006 |

(Continued)

OTHER PUBLICATIONS

European Search Report by European patent Office on Mar. 2, 2007.

*Primary Examiner*—Alexander S Beck
*Assistant Examiner*—Charles Hicks
(74) *Attorney, Agent, or Firm*—Knobbe Martens Olson & Bear LLP

(57) ABSTRACT

A plasma display device including a first electrode, a second electrode, and a third electrode crossing the first electrode and the second electrode is disclosed. A plurality of first sustain pulses are applied to the first electrode and a plurality of second sustain pulses are applied to the second electrode during a sustain period of a first subfield. A voltage at the first electrode gradually decreases from a third voltage to a fourth voltage after the voltage at the first electrode gradually increases from a first voltage to a second voltage, during a sub-reset period of a second subfield being consecutive to the first subfield. The plurality of second sustain pulses includes a first group and a second group, the second group includes the last one of the second sustain pulses, and a second sustain pulse of the second group has a different characteristic (e.g., pulse width) from a second sustain pulse of the first group.

16 Claims, 10 Drawing Sheets

FOREIGN PATENT DOCUMENTS

| | | | |
|---|---|---|---|
| EP | 1 679 684 | A2 | 7/2006 |
| EP | 1 693 820 | A1 | 8/2006 |
| FR | 2 738 654 | A1 | 3/1997 |
| KR | 10-2002-0004767 | A | 1/2002 |
| KR | 10-2002-0061913 | A | 7/2002 |
| KR | 10-2004-0007708 | | 1/2004 |
| KR | 10-2005-0041441 | A | 5/2005 |
| KR | 10-2005-0042987 | | 5/2005 |

* cited by examiner

PLASMA DISPLAY DEVICE AND METHOD OF DRIVING THE SAME

CROSS-REFERENCE TO RELATED APPLICATION

This application claims priority to and the benefit of Korean Patent Application No. 10-2005-0110679, filed in the Korean Intellectual Property Office on Nov. 18, 2005, the entire content of which is incorporated herein by reference.

BACKGROUND OF THE INVENTION

1. Field of the Invention

The present invention relates to a plasma display device and a method of driving the same, and more particularly, to a method of driving a plasma display device in a reset period.

2. Description of the Related Art

A plasma display device displays characters and images using plasma generated by gas discharge. The plasma display device operates by dividing a field into a plurality of weighted subfields, and gray scales are represented by the sum of weights according to the combination of turned-on subfields. A discharge cell (hereinafter referred to as a "cell") is initialized by a reset discharge during a reset period of each subfield, and an on-cell and an off-cell are selected during an address period of the each subfield. The on-cell is sustain discharged during a sustain period of each subfield so that images are displayed. The reset period is either a main reset period or a sub-reset period. The reset discharge is generated in all the cells during the main reset period, and is only generated in the cell having undergone the sustain discharge in the previous subfield during the sub-reset period.

Generally, the sustain period ends with a high voltage applied to a scan electrode. In the sub-reset period, a voltage at the scan electrode gradually decreases while a positive voltage is applied to a sustain electrode and a ground voltage is applied to an address electrode. When the sustain discharge is generated by the high voltage applied to the scan electrode, negative wall charges are formed on the scan electrode and more positive wall charges are formed on the sustain electrode than positive wall charges formed on the address electrode. Accordingly, a discharge is first generated between the scan electrode and the sustain electrode when gradually decreasing a voltage at the scan electrode, and another discharge is generated between the scan electrode and the address electrode. Then, the discharge between the scan electrode and the address electrode may not be normally generated because the discharge between the scan electrode and the sustain electrode is generated first. As a result, the wall charge states between the scan electrode and the address electrode may not be uniform in the cells.

In cells having insufficient wall charges formed between the scan electrode and the address electrode, a weak discharge may be generated in the address period, which may generate fewer wall charges, thereby generating an insufficient sustain discharge in the sustain period. On the other hand, in cells having excess wall charges formed between the scan electrode and the address electrode, a misfiring discharge for sustain discharging a turned-off cell may be generated.

SUMMARY OF CERTAIN INVENTIVE ASPECTS

One aspect of the present invention provides a plasma display device having a sub-reset period for allowing an address operation to be normally performed, and a method of driving the same.

Another aspect of the present invention discloses a method of driving a plasma display device including a first electrode, a second electrode, a third electrode crossing the first electrode and the second electrode, and a discharge cell formed by the first electrode, the second electrode, and the third electrode. According to the method, a field is divided into a plurality of subfields, and a plurality of first sustain pulses are applied to the first electrode and a plurality of second sustain pulses to the second electrode during a sustain period of a first subfield of the plurality of subfields. During a sub-reset period of a second subfield being consecutive to the first subfield, a voltage at the first electrode is gradually increased from a first voltage to a second voltage, and gradually decreased from a third voltage to a fourth voltage. The plurality of second sustain pulses includes a first group and a second group, the second group includes a last second sustain pulse, and a second sustain pulse of the second group is different from a second sustain pulse of the first group.

The second sustain pulse of the second group may have a longer width than the second sustain pulse of the first group.

At least part of a rising period at the second sustain pulse of the second group may be overlapped with at least part of a falling period at a first sustain pulse that is applied to the first electrode just before the second sustain pulse of the second group is applied to the second electrode.

A rising period at the second sustain pulse of the second group may be earlier than a falling period at a first sustain pulse that is applied to the first electrode just before the second sustain pulse of the second group is applied to the second electrode.

A rising period at the second sustain pulse of the second group may be shorter than a falling period at the second sustain pulse of the first group.

In one embodiment, a value gained by subtracting a voltage at the second voltage from a voltage at the first electrode is gradually increased from a first voltage to a second voltage, and is gradually decreased from a third voltage to a fourth voltage, during a reset period of a first subfield of the plurality of subfields. The value is gradually increased from a fifth voltage to a sixth voltage that is lower than the second voltage and is gradually decreased from a seventh voltage to an eighth voltage, during a reset period of a second subfield of the plurality of subfields. At least one first sustain pulse is applied to the second electrode during a first period in a sustain period of a third subfield corresponding to a previous subfield of the second subfield, and at least one second sustain pulse that is different from the at least one first sustain pulse is applied to the second electrode during a second period after the first period in the sustain period of the third subfield.

Still another aspect of the present invention discloses a plasma display device including a plurality of first electrodes, a plurality of second electrodes, a plurality of third electrodes crossing the plurality of first electrodes and the plurality of second electrodes, a plurality of discharge cells, a controller for dividing a field into a plurality of subfields, and a driver. The driver is adapted to apply at least one first sustain pulse to the plurality of discharge cells after applying at least one second sustain pulse, which is different from the at least one first sustain pulse, to the plurality of discharge cells during a sustain period of a first subfield among the plurality of subfields. The driver is further adapted to apply a reset waveform to the plurality of discharge cells during a reset period of a second subfield being consecutive to the first subfield. The reset waveform includes a first driving waveform and a second driving waveform. The first driving waveform is adapted to gradually decrease a value gained by subtracting a voltage at each of the plurality of second electrodes from a voltage at each of the plurality of first electrodes and a value gained by subtracting a voltage at each of the plurality of third electrodes from a voltage at each of the plurality of first electrodes. The second driving waveform is adapted to establish wall voltages in at least one of the plurality of discharge cells to generate a discharge between the first electrode and the third electrode corresponding to the at least one of the plurality of discharge cells before generating a discharge between the first electrode and the second electrode corresponding to the at least one of the plurality of discharge cells.

DETAILED DESCRIPTION OF CERTAIN INVENTIVE EMBODIMENTS

Figure 1:
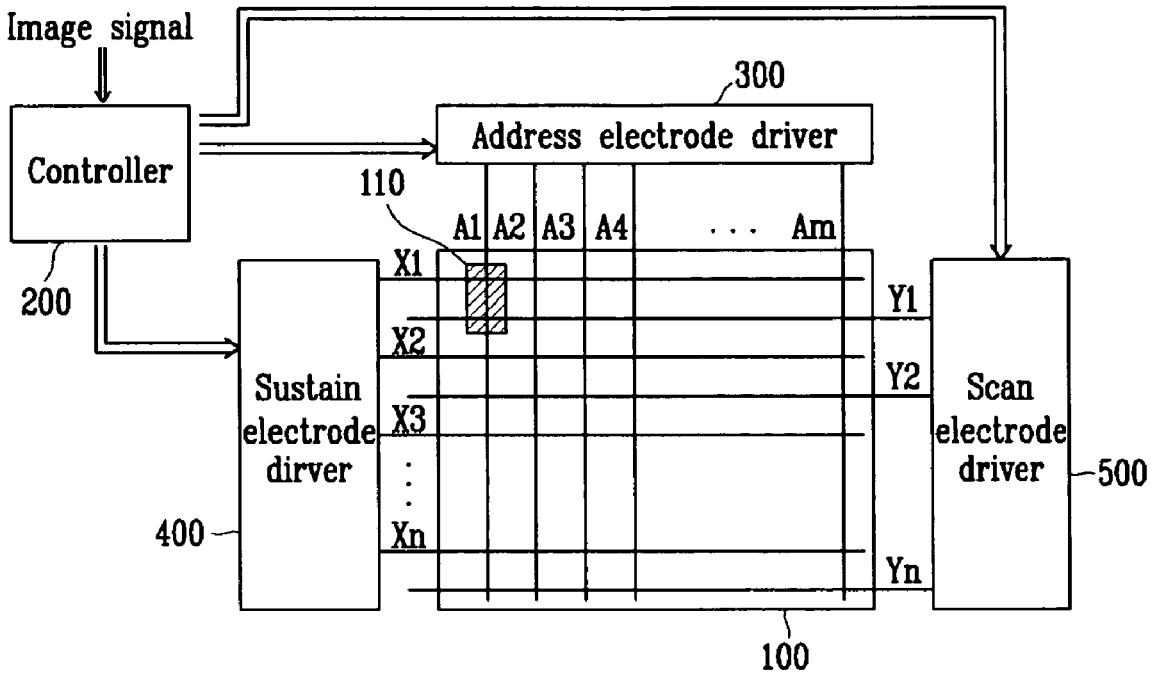
FIG. 1 is a schematic diagram showing a plasma display device according to exemplary embodiments of the present invention.

In the following detailed description, only certain exemplary embodiments of the present invention are shown and described, simply by way of illustration. As those skilled in the art would realize, the described embodiments may be modified in various different ways, all without departing from the spirit or scope of the present invention. Accordingly, the drawings and description are to be regarded as illustrative in nature, and not restrictive. There may be parts shown in the drawings, or parts not shown in the drawings, that are not discussed in the specification as they are not essential to a complete understanding of the invention. Like reference numerals designate like elements.

Wall charges indicate charges formed on a wall of discharge cells neighboring each electrode and accumulated to electrodes. Although the wall charges do not actually touch the electrodes, it will be described that the wall charges are "generated," "formed," or "accumulated" thereon. Also, a wall voltage represents a potential difference formed on the wall of the discharge cells by the wall charges, and a wall potential of an electrode means a potential formed by wall charges formed on the electrode. Further, "erase," "erasing," and "erased" require removal of all traces of the thing being erased.

Exemplary embodiments of the present invention will now be described in detail with reference to the drawings.

As shown in FIG. 1, a plasma display device according to an exemplary embodiment of the present invention includes a plasma display panel (PDP) 100, a controller 200, an address electrode driver (hereinafter referred to as an "A electrode driver") 300, a sustain electrode driver (hereinafter referred to as an "X electrode driver") 400, and a scan electrode driver (hereinafter referred to as a "Y electrode driver") 500.

The PDP 100 includes a plurality of address electrodes A1 to Am (hereinafter referred to as "A electrodes") extending in the column direction, and a plurality of scan electrodes Y1 to Yn (hereinafter referred to as "Y electrodes") and a plurality of sustain electrodes X1 to Xn (hereinafter referred to as "X electrodes"), each extending in the row direction. The respective X electrodes X1 to Xn may be formed corresponding to the respective Y electrodes Y1 to Yn, and the Y electrodes Y1 to Yn and the X electrodes X1 to Xn cross the A electrodes A1 to Am. A discharge space defined by i) each of the A electrodes A1 to Am, ii) each of the Y electrodes Y1 to Yn, and iii) each of the X electrodes X1 to Xn forms a discharge cell (hereinafter referred to as a "cell") 110. The cell 100 may correspond to a sub-pixel.

The controller 200 receives an external image signal, and outputs driving control signals. The controller 200 divides a field into a plurality of subfields, each having a brightness weight. Each subfield includes a reset period, an address period, and a sustain period.

In the reset period, the drivers 300, 400, and 500 apply voltages for the reset operation to the A electrodes A1 to Am, the X electrodes X1 to Xn, and the Y electrodes Y1 to initialize the cells 110. In some of the plurality subfields, the reset period may be a main reset period for generating a reset discharge in all the cells 110. In the remaining subfields, the reset period may be a sub-reset period for generating the reset discharge in a cell 110 that has been sustain-discharged in a previous subfield.

In the address period, the Y electrode driver 500 applies scan pulses to the Y electrodes Y1 to Yn in an order for selecting the Y electrodes (e.g., sequentially), and the A electrode driver 300 applies address pulses for select an on-cell or off-cell to the respective A electrodes A1 to Am whenever the scan pulse is applied to at least one of the Y electrodes Y1 to Yn. In the sustain period, the X electrode driver 400 and the Y electrode driver 500 apply a voltage for a sustain-discharge to the X electrodes X1-Xn and the Y electrodes Y1-Yn.

Driving waveforms applied to the A electrodes A1 to Am, the X electrodes X1 to Xn, and the Y electrodes Y1 to Yn will be described with reference to FIG. 2 to FIG. 10 based on a cell 110 defined by an A electrode, an X electrode, and a Y electrode.

Figure 2:
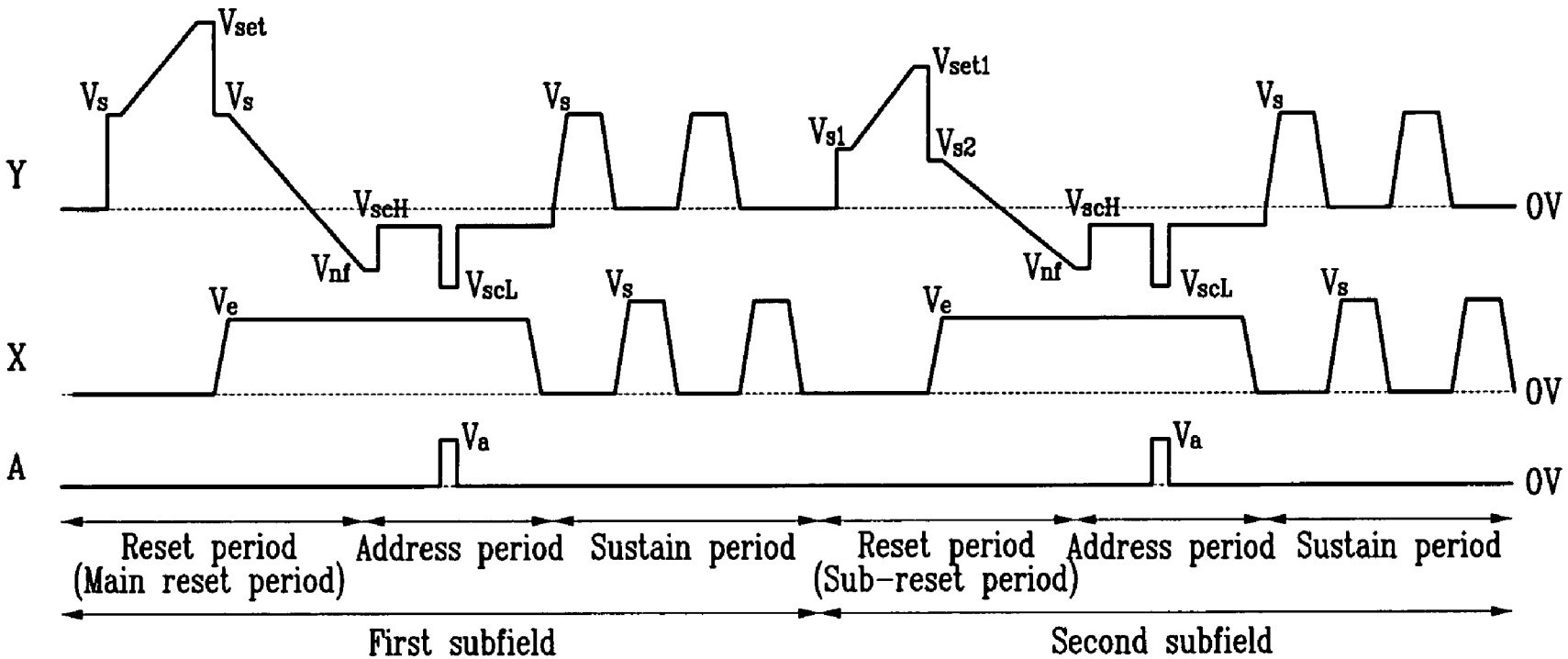
FIG. 2 shows driving waveforms of a plasma display device according to a first exemplary embodiment of the present invention.
Figure 3A:
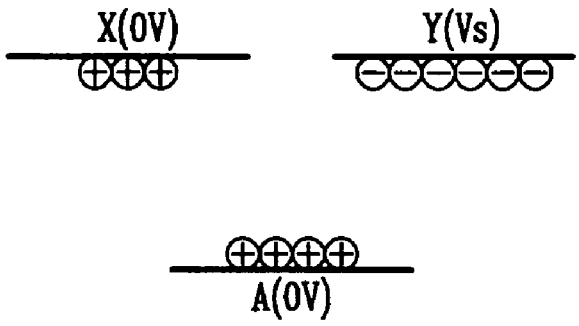
FIG. 3A, FIG. 3B, FIG. 3C, and FIG. 3D show wall charge states when a sustain discharge is generated in a sustain period of a first subfield of FIG. 2.
Figure 3B:
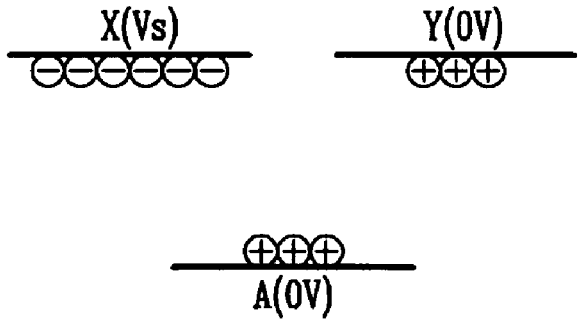
Figure 3C:
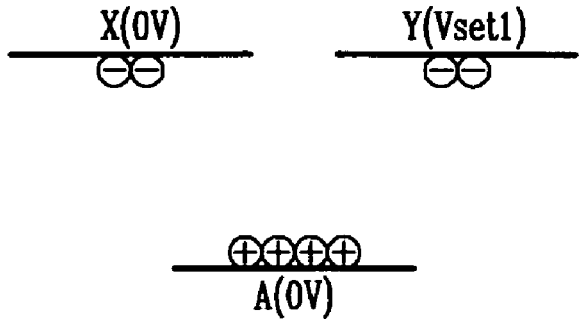
Figure 3D:
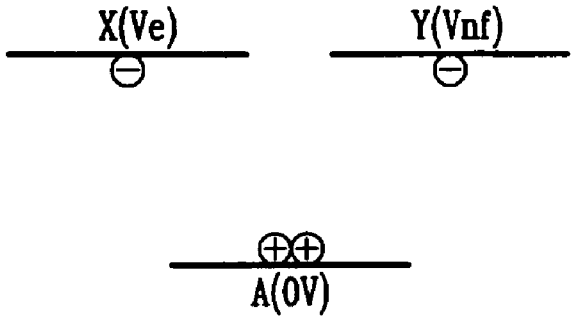
Figure 4A:
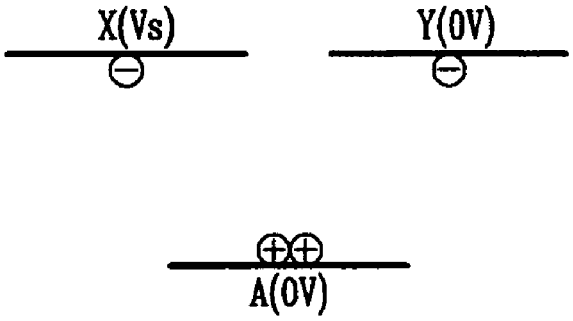
FIG. 4A and FIG. 4B show wall charge states when the sustain discharge is not generated in the sustain period of the first subfield of FIG. 2.
Figure 4B:
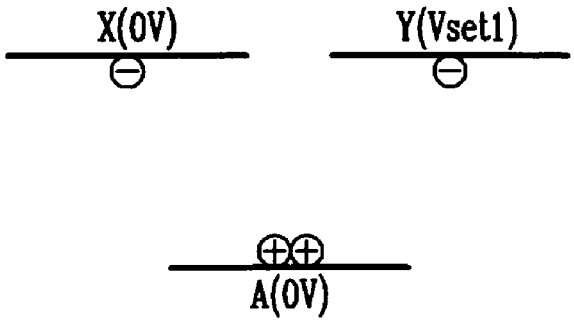

FIG. 2 shows driving waveforms of a plasma display device according to a first exemplary embodiment of the present invention. FIG. 3A, FIG. 3B, FIG. 3C, and FIG. 3D show wall charge states when a sustain-discharge is generated in a sustain period of a first subfield of FIG. 2, and FIG. 4A and FIG. 4B show wall charge states when the sustain-discharge is not generated in the sustain period of the first subfield of FIG. 2. FIG. 2 shows two subfields among a plurality of subfields, which include a first subfield and a second subfield.

As shown in FIG. 2, each of the first and second subfields includes a reset period, an address period, and a sustain period. The reset period of the first subfield is depicted as a main reset period, and the reset period of the second subfield is depicted a sub-reset period in FIG. 2.

In the main reset period, the drivers 300, 400, and 500 gradually increase a voltage at the Y electrode from a voltage of Vs to a voltage of Vset while applying a reference voltage which is, for example, a ground voltage 0V as in FIG. 2 to the X and A electrodes. In FIG. 2, the voltage at the Y electrode is depicted to increase as a ramp type. While the voltage at the Y electrode increases, a weak discharge is generated between the Y electrode and the X electrode, and between the Y electrode and the A electrode. As a result, negative wall charges are formed on the Y electrode, and positive wall charges are formed on the X electrode and the A electrode. The voltage of Vset may be set to be higher than a discharge firing voltage Vfxy between the Y electrode and the X electrode to generate the weak discharge in all the cells.

Subsequently, the drivers 300, 400, and 500 gradually decrease the voltage at the Y electrode from the voltage of Vs to a voltage of Vnf while applying the reference voltage 0V and a voltage of Ve to the A electrode and the X electrode, respectively. The weak discharge is generated between the Y electrode and the X electrode, and between the Y electrode and the A electrode, while the voltage at the Y electrode decreases. Then, the negative wall charges on the Y electrode are erased, and the positive wall charges on the X electrode and the A electrode are erased. The voltage of Ve and the voltage of Vnf may be established so that the wall voltage between the Y electrode and the X electrode is near 0V in order to prevent a misfiring discharge in an off-cell. That is, a voltage of (Ve−Vnf) may be established to be near the discharge firing voltage between the Y electrode and the X electrode.

In the address period, the Y electrode driver 500 applies a scan pulse having a voltage of VscL to the Y electrode, and the A electrode driver 300 applies an address pulse having a voltage of Va to the A electrode to select an on-cell while the X electrode driver 400 maintains the X electrode at the voltage of Ve. The other Y electrodes which are not applied with the scan pulse are biased at a voltage of VscH, which is higher than the voltage of VscL, and the reference voltage 0V is applied to the other A electrodes which pass through the cells to be selected as off-cells. The voltage of VscL may be equal to or lower than the voltage of Vnf.

In more detail, while the Y electrode driver 500 applies the scan pulse to the Y electrode in a first row (Y1 in FIG. 1), the A electrode driver 300 applies the address pulse to the A electrode in a cell to be selected as an on-cell among the first row, thereby generating an address discharge between them. Another discharge is generated between the Y electrode Y1 and the X electrode of the cell to be selected as the on-cell. Accordingly, positive wall charges are formed on the Y electrode, and negative wall charges are formed on the A electrode and the X electrode of the cell to be turned on.

Subsequently, while the Y electrode driver 500 applies the scan pulse to the Y electrode in a next row (for example, a second row Y2 in FIG. 1), the A electrode driver 300 applies the address pulse to the A electrode in a cell to be selected as an on-cell among the second row, thereby generating an address discharge in the cell formed by the A electrode and the Y electrode. Then, wall charges are formed as described above. In this manner, while applying the scan pulse the Y electrodes in the other rows, the address pulse is applied to the A electrode in a cell to be selected as an on-cell, thereby forming the wall charges.

In the sustain period, the Y and X electrode drivers 400 and 500 respectively apply a sustain pulse having the voltage of Vs to the Y electrode and the reference voltage 0V to the X electrode because the positive wall charges are formed on the Y electrode and the negative wall charges are formed on the X electrode by the address discharge. Then, the sustain discharge is generated between the Y electrode and the X electrode in the on-cell that was address discharged in the address period. As shown in FIG. 3A, in the on-cell where the sustain-discharge is generated, positive wall charges and negative wall charges are formed on the X electrode and the Y electrode, respectively, and positive wall charges are formed on the A electrode receiving the reference voltage 0V.

Next, the reference voltage is applied to the Y electrode, and the sustain pulse having the voltage of Vs is applied to the X electrode. Then, a sustain discharge is generated between the Y electrode and the X electrode because the wall voltage is formed between the Y electrode and the X electrode by the previous sustain-discharge. Therefore, as shown in FIG. 3B, positive wall charges and negative wall charges are formed on the Y electrode and the X electrode, respectively, and positive wall charges are formed on the A electrode.

The sustain pulse having the voltage of Vs is alternatively applied to the Y electrode and to the X electrode depending upon a weight of a corresponding subfield.

If the voltage at the Y electrode is gradually decreased during the sub-reset period after the voltage of Vs is applied to the Y electrode as described in the prior art, a discharge between the Y electrode and the X electrode may be generated earlier than a discharge between the Y electrode and the A electrode during the sub-reset period. This is because the wall potential of the X electrode is higher than the wall potential of the Y electrode and the difference between the voltages applied to the Y electrode and the X electrode is greater than the difference between the voltages applied to the Y electrode and the A electrode when the voltage at the Y electrode gradually decreases. Then, a weak discharge between the X electrode and the Y electrode is mainly generated, compared to the weak discharge between the A electrode and the Y electrode. As a result, wall charge states on the A electrode and the Y electrode may not be properly formed.

Accordingly, in the first exemplary embodiment of the present invention, the voltage at the Y electrode gradually increases from a voltage of Vs1 to a voltage of Vset1, and then, gradually decreased from a voltage of Vs2 to the voltage of Vnf during the sub-reset period of the second subfield.

In more detail, after the Y electrode driver 500 applies the voltage of Vs to the X electrode in the sustain period of the first subfield to generate wall charges in the on-cell as shown in FIG. 3B, the X electrode driver 400 applies the reference voltage to the X electrode, and the Y electrode driver 500 gradually increases the voltage at the Y electrode from the voltage of Vs1 to the voltage of Vset1. Then, a weak discharge is generated between the Y electrode and the X electrode when a sum of the voltage applied to the Y electrode and the wall voltage between the X electrode and the Y electrode exceeds the discharge firing voltage between the X and Y electrodes in the wall charge state shown in FIG. 3B. Additionally, while the voltage at the Y electrode increases, a weak discharge is also generated between the Y electrode and the A electrode when the sum of the voltage applied to the Y electrode and the wall voltage between the Y electrode and the A electrode exceeds a discharge firing voltage between the Y and A electrodes.

However, the discharge firing voltage between the A electrode and the Y electrode is generally less than the discharge firing voltage between the X electrode and the Y electrode. Consequently, as FIG. 3C shows, the wall potential of the A electrode on the Y electrode becomes higher than the wall potential of the X electrode on the Y electrode. Referring to FIG. 2 again, the voltage at the Y electrode gradually increases from the voltage of Vs1 which is higher than the reference voltage. In one embodiment, the voltage at the Y electrode may gradually increase from the reference voltage 0V, but the time length of the sub-reset period is longer than the case that the voltage at the Y electrode starts from the voltage of Vs1. At this time, the voltage of Vs1 may be established so that the sum of the wall voltage formed in a state shown in FIG. 3B and the voltage of Vs1 does not exceed the discharge firing voltage between the X electrode and the Y electrode. In addition, the voltage of Vs1 may be established to be lower than the voltage of Vs and higher than the reference voltage because the sustain discharge may be generated between the X electrode and the Y electrode when the voltage of Vs is applied in the state shown in FIG. 3B.

Subsequently, the Y electrode driver 500 gradually decreases the voltage at the Y electrode from the voltage of Vs2 to the voltage of Vnf while the X and A electrode drivers 400 and 300 apply the voltage of Ve and the reference voltage to the X electrode and the A electrode, respectively. FIG. 3D shows the resulting charge states. In one embodiment, the voltage at the Y electrodes may gradually decrease from the voltage of Vset1. However, because gradually decreasing the voltage at the Y electrode from the voltage of Vset1 to the voltage of Vnf would increase the time length of the sub-reset period, the voltage at the Y electrode decreases from the voltage of Vs2 which is a level that does not cause the discharge. At this time, the wall voltage between the Y electrode and the A electrode is greater than the wall voltage between the Y electrode and the X electrode, and the discharge firing voltage between the Y electrode and the A electrode is generally less than the discharge firing voltage Vfxy between the Y electrode and the X electrode. Consequently, a weak discharge between the A electrode and the Y electrode may be generated earlier than a weak discharge between the X electrode and the Y electrode even when applying the voltage of Ve to the X electrode. Accordingly, the wall charge state between the A electrode and the Y electrode may be uniformly formed in the cells because the weak discharge between the X electrode and the Y electrode is mainly formed in the sub-reset period compared to the weak discharge between the A electrode and the Y electrode.

Next, an on-cell is selected by the address discharge in the address period, and the sustain-discharge operation is performed for the on-cell in the sustain period. At this time, because the wall charge states between the A electrodes and the Y electrodes may be similarly established for all the cells in the sub-reset period, the address discharge is uniformly generated in the address period, thereby preventing insufficient discharges and misfiring discharges.

The sub-reset period described in the second subfield may also be performed in the following subfields. Also, some of the plurality of subfields forming a field may use the main reset period and the rest may use the sub-reset period.

Conditions of the voltage of Vset1 in the driving waveform according to the first exemplary embodiment will now be described. The reset period of the second subfield is the sub-reset period. Therefore, the reset discharge is generated in the cell having undergone the sustain-discharge in a previous subfield. That is, the voltage of Vset1 may be set so that the reset discharge is not generated in the cell not having undergone the sustain discharge in the previous subfield. Accordingly, the voltage of Vset1 may be set to be lower than the voltage of Vset because the reset discharge is generated in all the cells when the voltage at the Y electrode increases to the voltage of Vset as described above.

In addition, the cell that has not been sustain-discharged in the previous subfield is maintained at the wall charge state established in the reset period of the previous subfield, as shown in FIG. 4A, because the address discharge has not been generated in the previous subfield. A wall voltage Vwnf at the Y electrode on the X electrode is given as Equation 1 at the end of the reset period of the previous subfield because the voltage of Vnf is applied to the Y electrode and the voltage of Ve is applied to the X electrode.

$$Vwnf=-Vfxy-Vnf+Ve \qquad \text{Equation 1}$$

where Vfxy denotes a discharge firing voltage between the X electrode and the Y electrode.

When the sum of the wall voltage Vwnf and the voltage applied to the Y electrode does not exceed the discharge firing voltage Vfxy, a discharge may not be generated in the cell having the wall charge state shown in Equation 1 during the sub-reset period of the second subfield. That is, no discharge may be generated in the cell that has not experienced the sustain-discharge in the previous subfield during the sub-reset period when the sum of the voltage of Vset1 and the wall voltage Vwnf is lower than or substantially the same as the discharge firing voltage as shown in Equation 2. Then, as shown in FIG. 4B, the cell may be maintained at the wall charge state established in the reset period of the previous subfield (i.e., the first subfield). That is, the voltage of Vset1 may satisfy Equation 3 according to Equations 1 and 2. Additionally, the voltage of (Ve−Vnf) may correspond to the discharge firing voltage Vfxy because the wall voltage between the X electrode and the Y electrode may be near 0V in the reset period for the purpose of preventing the misfiring discharge in the sustain period. Accordingly, the voltage of Vset1 in the reset period of the second subfield may be lower than the discharge firing voltage Vfxy between the X electrode and the Y electrode, that is, the voltage of (Ve−Vnf).

$$Vwnf+Vset1 \leqq Vfxy \qquad \text{Equation 2}$$

$$Vset1 \leqq 2Vfxy-(Ve-Vnf) \approx Vfxy \approx Ve-Vnf \qquad \text{Equation 3}$$

In one embodiment, the voltage of Vset1 is set to be higher than the discharge firing voltage Vfay between the A electrode and the Y electrode. Then, the wall charges may be erased between the X electrode and the Y electrode, and a wall potential of the A electrode may be higher than a wall potential of the Y electrode when Accordingly, the discharge between the A electrode and the Y electrode may be generated before the discharge between the X electrode and the Y electrode during the sub-reset period.

As described above, the first exemplary embodiment of the present invention gradually decreases the voltage at the Y electrode after setting the wall charges in the on-cell through the weak discharge, thereby initializing the on-cell during the sub-reset period. Therefore, the weak discharge may be easily generated when the sufficient wall charges are formed in the on-cell before the sub-reset period. Exemplary embodiments for forming the sufficient wall charges in the on-cell before the sub-reset period will be described with reference to FIG. 5 to FIG. 8 below.

FIGS. 5-8 show driving waveforms of plasma display devices according to second, third, fourth, and fifth exemplary embodiments of the present invention, respectively.

Figure 5:
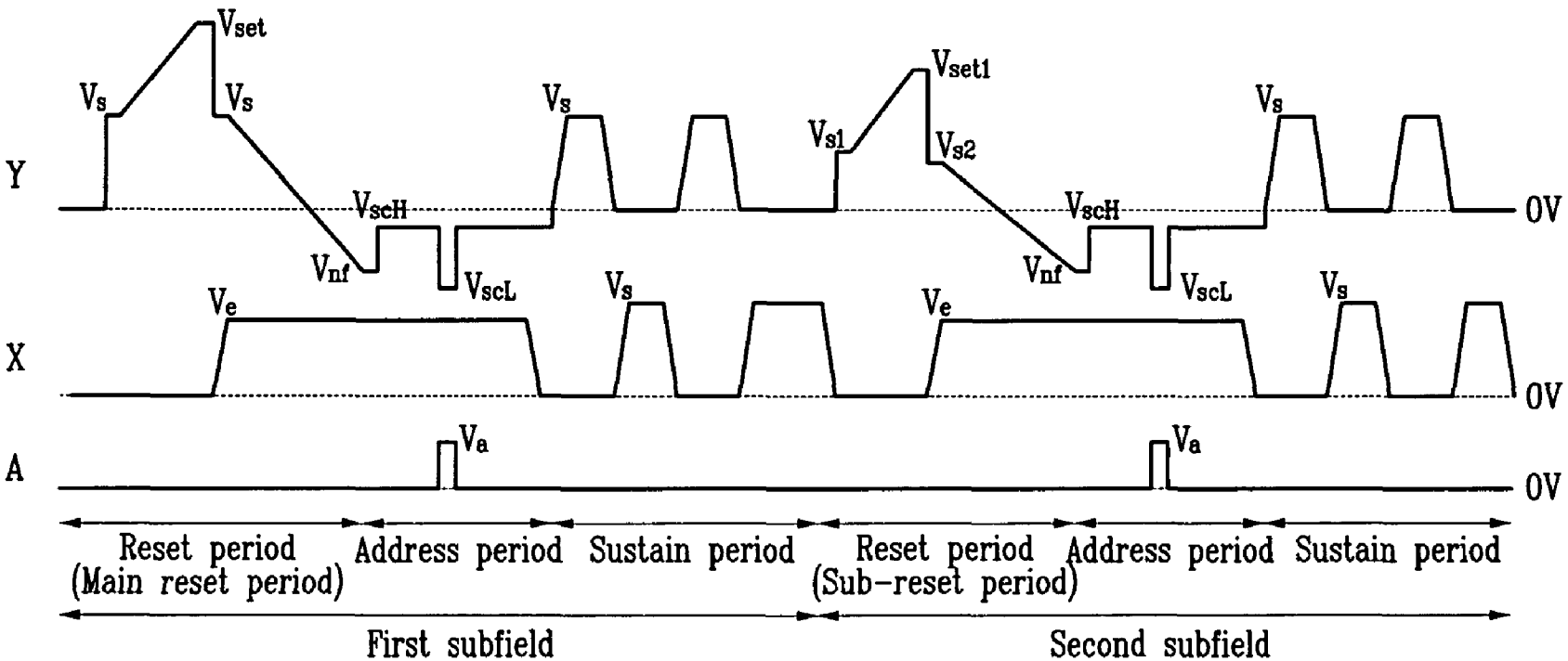
FIG. 5, FIG. 6, FIG. 7, FIG. 8, FIG. 9, and FIG. 10 show driving waveforms of plasma display devices according to second, third, fourth, fifth, sixth, and seventh exemplary embodiments of the present invention, respectively.

Referring to FIG. 5, in a first subfield, the second exemplary embodiment sets a width of a last sustain pulse that is applied to the X electrode in a sustain period to be longer than a width of each of the other sustain pulses. Then, charges occurred through a last sustain discharge may be sufficiently formed on the cell because a period in which a voltage difference between the X electrode and the Y electrode and a voltage difference between the X electrode and the A electrode are maintained at the voltage of Vs gets longer.

Figure 6:
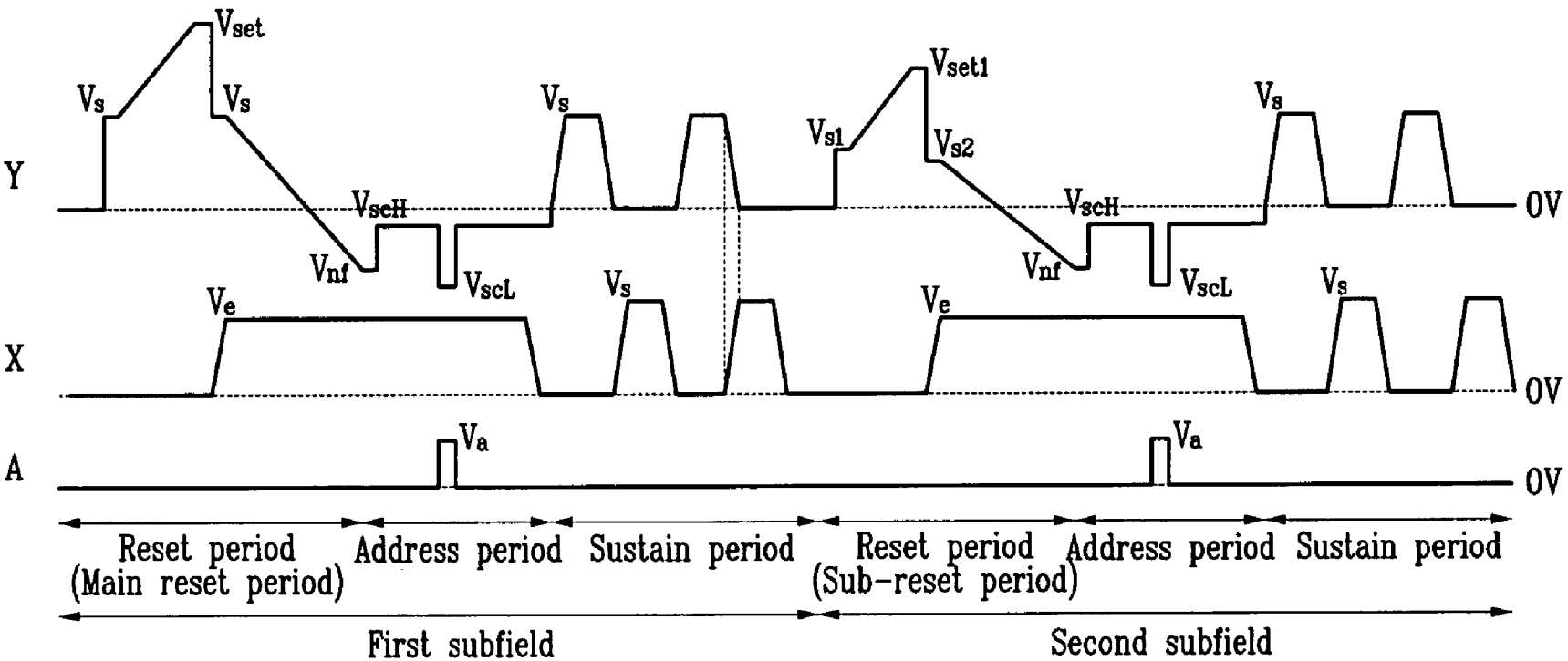

Referring to FIG. 6, in a first subfield, the third exemplary embodiment sets a last sustain pulse that is applied to the X electrode to be overlapped with a sustain pulse that is applied to the Y electrode just before the last sustain pulse. That is, at least part of a rising period at the last sustain pulse is overlapped with at least part of a falling period at the sustain pulse applied to the Y electrode before the last sustain pulse. Herein, the rising period is a period in which the voltage of the sustain pulse increases from about the reference voltage 0V to about the voltage of Vs, and the falling period is a period in which the voltage of the sustain period is reduced from about the voltage of Vs to about the reference voltage 0V. Generally, a self-erasing discharge may be generated due to a voltage variance from the voltage of Vs to the voltage of 0V during the falling period of the sustain pulse so that some of the wall charges may be erased. However, if the rising period is overlapped with the falling period as described in the third exemplary embodiment, the sustain discharge may be generated before the voltage of the sustain pulse applied to the Y electrode decreases to the reference voltage 0V such that the self erasing discharge may not be generated. That is, the sustain discharge may be strongly generated so that sufficient wall charges may be formed in the cell.

Figure 7:
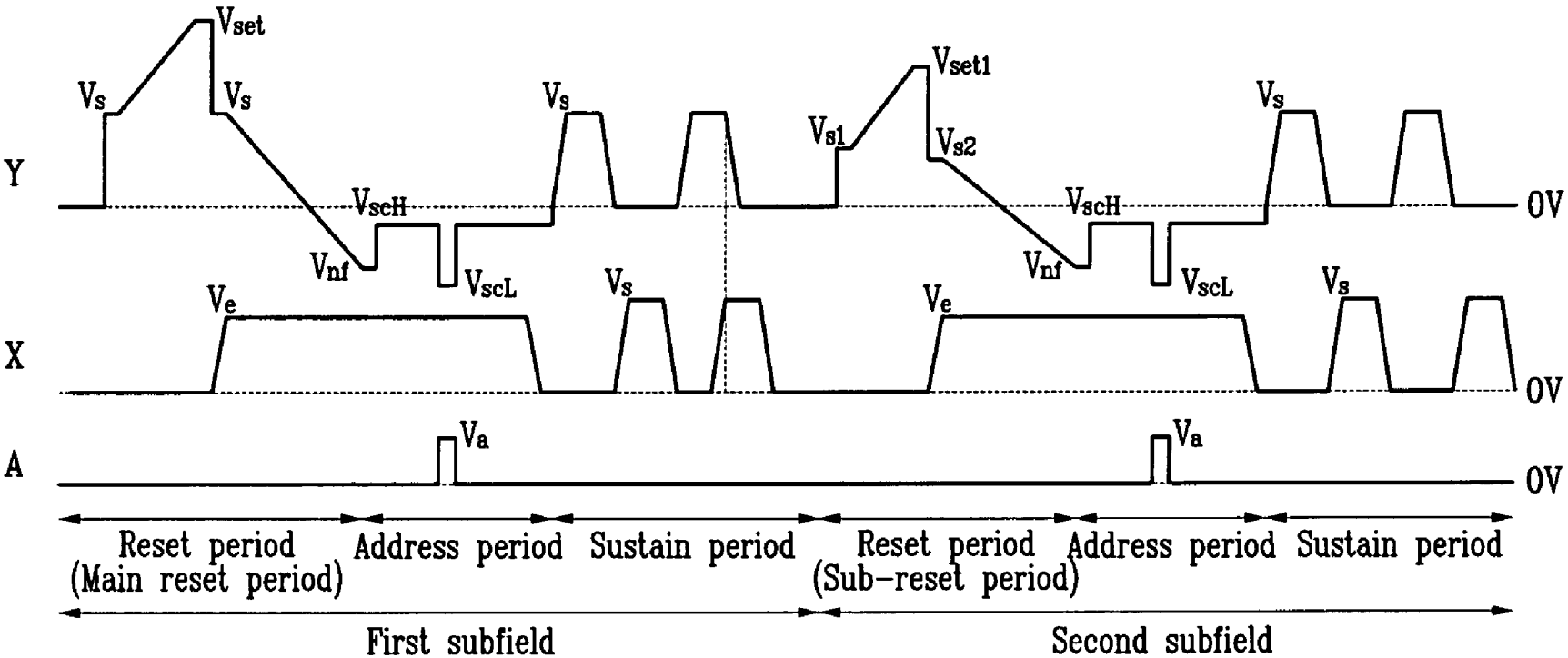

Referring to FIG. 7, in a first subfield, the fourth exemplary embodiment sets a period in which a last sustain pulse applied to the X electrode has about the voltage of Vs to be overlapped with a falling period of a sustain pulse that is applied to the Y electrode just before the last sustain pulse. That is, a rising period of the last sustain pulse applied to the X electrode is set to be earlier than a falling period of the sustain pulse applied to the Y electrode. Then, as described with respect to FIG. 6, the sufficient wall charges may be formed in the cell because the sustain discharge is generated before a self erasing discharge is generated.

Figure 8:
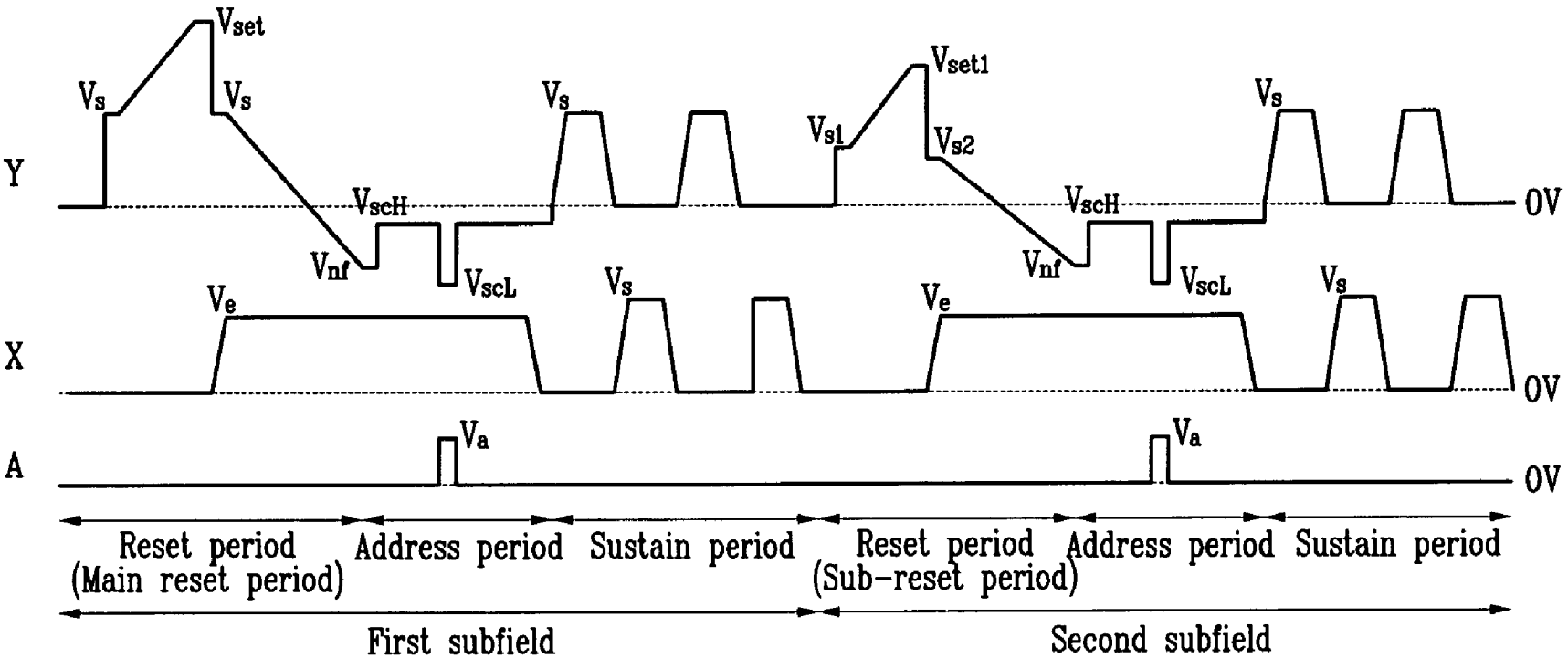

Referring to FIG. 8, in a first subfield, the fifth exemplary embodiment sets a rising period of a last sustain pulse that is applied to an X electrode to be shorter than a rising period of each of the other sustain pulses that are applied to the X electrode. Generally, the sustain discharge may be generated while the voltage at the X electrode increases to a voltage of Vs. At this time, a discharge current is not supplied from a voltage source supplying the voltage of Vs but is supplied from a resonance current for increasing the voltage at the X electrode to the voltage of Vs so that the sustain discharge may be weakly generated. However, if the voltage at the X electrode rapidly increases to the voltage of Vs as the fifth exemplary embodiment, the sustain discharge may be generated after the voltage of Vs is applied to the X electrode. That is, the sustain discharge may be strongly generated.

As described above, the second to fifth exemplary embodiments set characteristics (e.g., a shape or a timing) of the last sustain pulse applied to the X electrode to be different from the other sustain pulses so that the sufficient wall charges are formed in the cells.

While the second to fifth exemplary embodiments have been described to change the characteristic of the last sustain pulse applied to the X electrode, the characteristics of at least one sustain pulse applied to the X electrode before the last sustain pulse may be further changed. That is, the plurality of sustain pulses applied to the X electrode in the sustain period may be divided into at least two groups. One group (a first group) may include general sustain pulses, and the other group (a second group) may include sustain pulses that are set as described in the second to fifth exemplary embodiments. At this time, the sustain pulses of the first group may be applied to the X electrode during a first period of the sustain period, and the sustain pulses of the second group may be applied to the X electrode during a second period of the sustain period. The second period is after the first period, and includes the last sustain pulse applied to the X electrode.

In addition, the second to fifth exemplary embodiments may be applicable to a subfield just before a subfield having the sub-reset period. Furthermore, the modification described in the second to fifth exemplary embodiments may be applicable to exemplary embodiments described below.

Figure 9:
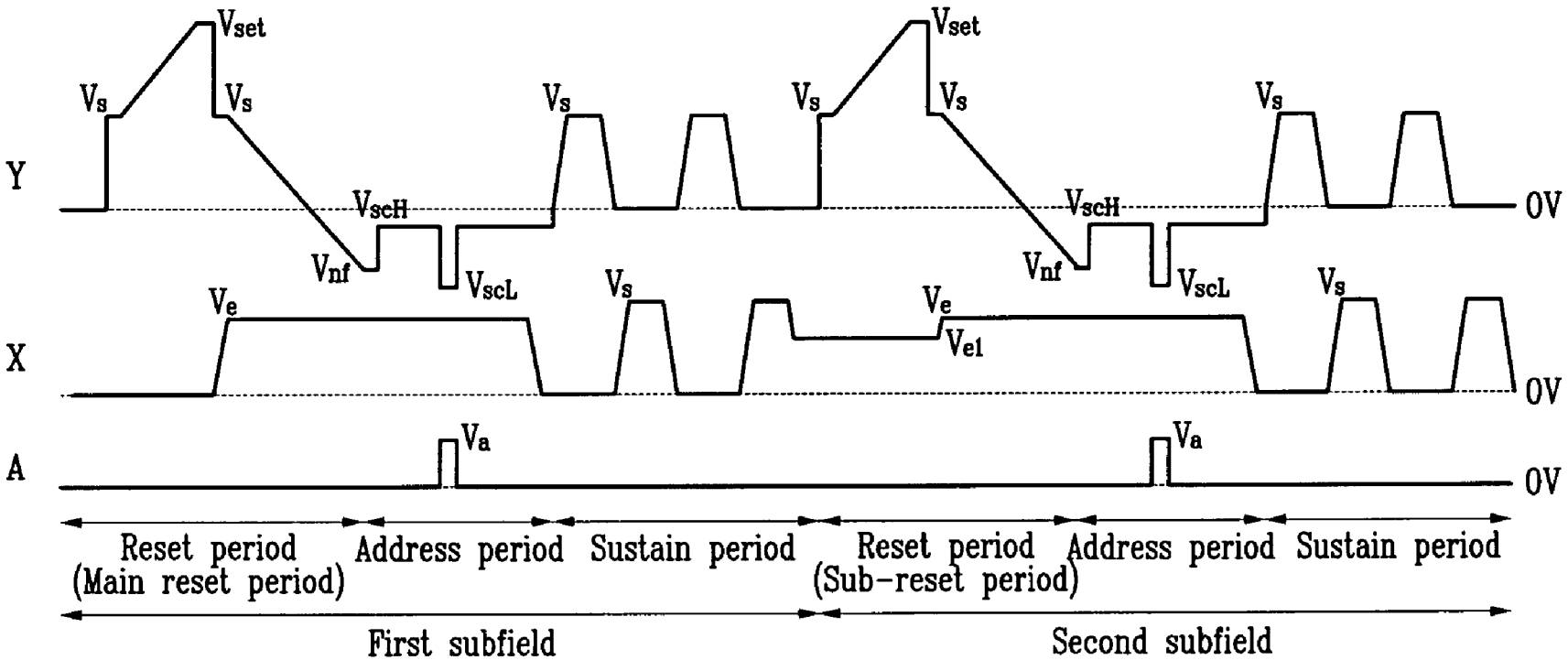
Figure 10:
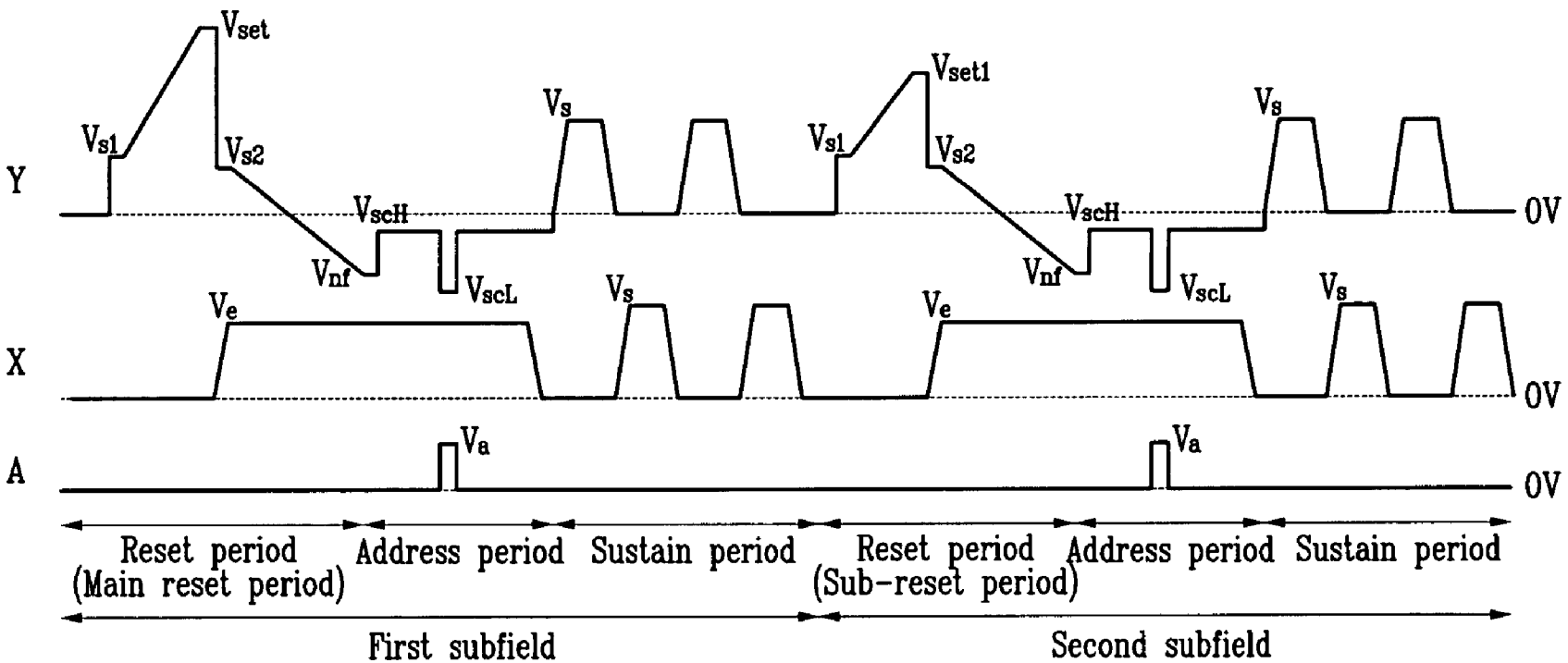

FIG. 9 and FIG. 10 show driving waveforms of plasma display devices according to sixth and seventh exemplary embodiments of the present invention, respectively.

As shown in FIG. 9, the driving waveforms according to the sixth exemplary embodiment correspond to those according to the first exemplary embodiment except for voltages applied to the X electrode and the Y electrode during a sub-reset period of a second subfield.

In more detail, the voltage at the Y electrode gradually increases to the voltage of Vset while the voltage at the X electrode is maintained at a voltage of Ve1 lower than a voltage of Ve. The difference between the voltage of Vset and the voltage of Ve1 is set to be the same as the difference between the voltage of Vset1 shown in FIG. 2 and the reference voltage 0V. Then, the wall voltage between the X electrode and the Y electrode is the same as the wall voltage which is set when the voltage at the Y electrode increases to the voltage of Vset in the first exemplary embodiment. At this time, gradually increasing the voltage at the Y electrode from the voltage of Vs can reduce the time length of the sub-reset period. According to the sixth exemplary embodiment, a wall voltage of the A electrode on the Y electrode is higher than that of the first exemplary embodiment since a voltage difference Vset between the Y electrode and an A electrode is greater than a voltage difference Vset1 of the first exemplary embodiment. Therefore, a discharge may be more stably generated between the A electrode and the Y electrode.

Referring to FIG. 10, the driving waveforms according to the seventh exemplary embodiment correspond to those according to the first exemplary embodiment except for a rising start voltage Vs1 and a falling start voltage Vs2 in a main reset period of a first subfield.

In more detail, after the voltage at the Y electrode gradually increases from the voltage of Vs1 to the voltage of Vset, the voltage at the Y electrode gradually decreases from the voltage of Vs2 to the voltage of Vnf. Herein, the voltage of Vs1 and the voltage of Vs2 are the same as the rising start voltage Vs1 of the Y electrode and the falling start voltage Vs2 of the Y electrode in a sub-reset period of a second subfield, respectively. Then, a main reset waveform of the Y electrode may be the same as a sub-reset waveform of the Y electrode.

While two subfields has been shown and described in the exemplary embodiments of the present invention, a subfield that is first located in a field may be formed as the first subfield and other subfields in the field may be formed like the second subfield. Also, more than two subfields like the first subfield may be used in a field.

In addition, while the voltage at the Y electrode has been depicted to increase or decrease in a ramp form during the reset period in FIG. 2, and FIGS. 5-10, it may increase or decrease in a curved form. In one embodiment, the voltage at the Y electrode may gradually vary by repeatedly changing a voltage to the Y electrode by a predetermined voltage and then floating the Y electrode.

Furthermore, the rising waveforms for erasing the wall charges on the Y electrode and the X electrode have been shown in the sub-reset period in the exemplary embodiments of the present invention. In one embodiment, the rising waveforms may be included in the sustain period of the previous subfield because they generates a discharge in the cell having undergone the sustain discharge in the sustain period of the previous subfield.

In one embodiment, the voltage applied to at least one of the Y electrode, the X electrode, and the A electrode may gradually vary if it satisfies a relative voltage difference between the electrodes while the voltage at the Y electrode gradually varies as described in the exemplary embodiments of the present invention.

As describe above, according to exemplary embodiments of the present invention, the reset discharge is mainly generated between the Y electrode and the A electrode during the sub-reset period because the wall charges formed on the Y electrode and the X electrode in the sustain period are erased and the wall voltage at the A electrode on the Y electrode is heightened. The wall charges between the Y electrode and the A electrode of the cells may be set to perform an appropriate address operation during the sub-reset period. In addition, the sufficient wall charges are formed in the cell by the sustain discharge occurred just before the sub-reset period so that the weak discharge may be normally generated in the sub-reset period.

While the above description has pointed out novel features of the invention as applied to various embodiments, the skilled person will understand that various omissions, substitutions, and changes in the form and details of the device or process illustrated may be made without departing from the scope of the invention. Therefore, the scope of the invention is defined by the appended claims rather than by the foregoing description. All variations coming within the meaning and range of equivalency of the claims are embraced within their scope.

What is claimed is:

1. A method of driving a plasma display device including a first electrode, a second electrode, a third electrode crossing the first electrode and the second electrode, and a discharge cell defined by the first electrode, the second electrode, and the third electrode, the method comprising:

dividing a field into a plurality of subfields;

applying a plurality of first sustain pulses to the first electrode and a plurality of second sustain pulses to the second electrode during a sustain period of a first subfield of the plurality of subfields;

gradually increasing a voltage at the first electrode from a first voltage to a second voltage during a sub-reset period of a second subfield being consecutive to the first subfield; and gradually decreasing the voltage at the first electrode from a third voltage to a fourth voltage during the sub-reset period, wherein the plurality of second sustain pulses are divided into at least a first group and a second group, and the second group includes the last one of the second sustain pulses, and wherein a second sustain pulse of the second group is different from a second sustain pulse of the first group, wherein the method further comprises:

applying a fifth voltage to the second electrode while gradually increasing the voltage at the first electrode;

applying a sixth voltage that is higher than the fifth voltage to the second electrode while gradually decreasing the voltage at the first electrode;

in a main reset period of a third subfield of the plurality of subfields, wherein the third subfield is consecutive in time to the second subfield:

gradually increasing the voltage at the first electrode from a seventh voltage to an eighth voltage while applying a ninth voltage to the second electrode; and gradually decreasing the voltage at the first electrode from a tenth voltage to an eleventh voltage while applying a twelfth voltage that is higher than the ninth voltage to the second electrode, wherein the difference between the second voltage and the fifth voltage is less than the difference between the eighth voltage and the ninth voltage.

2. The method of claim 1, wherein the second sustain pulse of the second group has a different characteristic from that of the first group.

3. The method of claim 1, wherein the second sustain pulse of the second group has a longer width than that of the first group.

4. The method of claim 1, wherein at least part of a rising period at the second sustain pulse of the second group is overlapped with at least part of a falling period at one of the plurality of first sustain pulses, wherein the one first sustain pulse is applied to the first electrode just before the second sustain pulse of the second group is applied to the second electrode.

5. The method of claim 1, wherein a rising period at the second sustain pulse of the second group occurs earlier than a falling period at one of the plurality of first sustain pulses, wherein the first sustain pulse is applied to the first electrode just before the second sustain pulse of the second group is applied to the second electrode.

6. The method of claim 1, wherein a rising period at the second sustain pulse of the second group is shorter than a falling period at the second sustain pulse of the first group.

7. The method of claim 1, wherein the second group includes only the last second sustain pulse.

8. The method of claim 1, wherein the discharge cell that has been an off-cell in the first subfield is not discharged during the sub-reset period.

9. The method of claim 1, wherein the sixth voltage is substantially the same as the twelfth voltage, and the fourth voltage is substantially the same as the eleventh voltage.

10. The method of claim 1, wherein the difference between the second voltage and the fifth voltage is less than or substantially the same as the difference between the fourth voltage and the sixth voltage.

11. A method of driving a plasma display device, comprising:

providing a first electrode, a second electrode, a third electrode crossing the first electrode and the second electrode, and a discharge cell defined by the first electrode, the second electrode, and the third electrode, wherein a field is divided into a plurality of subfields;

in a first subfield of the plurality of subfields:

driving the first and second electrodes so as to gradually increase a value from a first voltage to a second voltage during a reset period, wherein the value is the subtraction of a voltage at the second electrode from a voltage at the first electrode; and driving the first and second electrodes so as to gradually decrease the value from a third voltage to a fourth voltage during the reset period;

in a second subfield of the plurality of subfields:

driving the first and second electrodes so as to gradually increase the value from a fifth voltage to a sixth voltage which is lower than the second voltage during a reset period; and driving the first and second electrodes so as to gradually decrease the value from a seventh voltage to an eighth voltage during the reset period;

in a third subfield corresponding to a previous subfield of the second subfield:

applying at least one first sustain pulse to the second electrode during a first period of a sustain period; and applying at least one second sustain pulse having a different characteristic from the at least one first sustain pulse to the second electrode during a second period of the sustain period after the first period.

12. The method of claim 11, wherein the at least one second sustain pulse has a longer width than the at least one first sustain pulse.

13. The method of claim 11, further comprising applying a plurality of third sustain pulses to the first electrode, wherein at least part of a rising period of the at least one second sustain pulse is overlapped with at least part of a falling period of one of the plurality of third sustain pulses, wherein the one third sustain pulse is applied to the first electrode just before the at least one second sustain pulse is applied to the second electrode.

14. The method of claim 11, further comprising applying a plurality of third sustain pulses to the first electrode, wherein a rising period of the at least one second sustain pulse occurs earlier than a falling period of one of the plurality of third sustain pulses, wherein the one third sustain pulse is applied to the first electrode just before the at least one second sustain pulse is applied to the second electrode.

15. The method of claim 11, wherein a rising period of the at least one second sustain pulse is shorter than a rising period of the at least one first sustain pulse.

16. The method of claim 11, wherein the magnitude of the second voltage is greater than or substantially the same as that of the fourth voltage, and the magnitude of the sixth voltage is less than or substantially the same as that of the eighth voltage.

* * * * *